US007057611B2

(12) United States Patent
Lin et al.

(10) Patent No.: US 7,057,611 B2
(45) Date of Patent: Jun. 6, 2006

(54) INTEGRATED POWER SUPPLY FOR AN LCD PANEL

(75) Inventors: Yung-Lin Lin, Palo Alto, CA (US); Da Liu, San Jose, CA (US)

(73) Assignee: 02Micro International Limited, Grand Cayman (KY)

( * ) Notice: Subject to any disclaimer, the term of this patent is extended or adjusted under 35 U.S.C. 154(b) by 483 days.

(21) Appl. No.: 10/397,023

(22) Filed: Mar. 25, 2003

(65) Prior Publication Data

US 2004/0189095 A1 Sep. 30, 2004

(51) Int. Cl.
*G09G 5/00* (2006.01)

(52) U.S. Cl. ..... 345/211; 345/87; 345/204

(58) Field of Classification Search ..... 345/87–89, 345/90, 92, 94–95, 98, 100, 204, 205, 211, 345/212–214
See application file for complete search history.

(56) References Cited

U.S. PATENT DOCUMENTS

| | | | | |
|---|---|---|---|---|
| 4,461,980 | A | 7/1984 | Nilssen | 315/225 |
| 4,535,399 | A | 8/1985 | Szepesi | 363/20 |
| 4,541,041 | A | 9/1985 | Park et al. | 363/41 |
| 4,672,528 | A | 6/1987 | Park et al. | 363/98 |
| 4,727,469 | A | 2/1988 | Kammiller | 363/56 |
| 4,763,239 | A | 8/1988 | Ball | 363/98 |
| 4,794,506 | A | 12/1988 | Hino et al. | 363/17 |
| 4,814,962 | A | 3/1989 | Magalhaes et al. | 363/16 |
| 4,833,584 | A | 5/1989 | Divan | 363/37 |
| 4,855,888 | A | 8/1989 | Henze et al. | 363/132 |
| 4,860,189 | A | 8/1989 | Hitchcock | 363/132 |
| 4,864,483 | A | 9/1989 | Divan | 363/37 |
| 4,912,622 | A | 3/1990 | Steigerwald et al. | 363/98 |
| 4,935,857 | A | 6/1990 | Nguyen et al. | 363/17 |
| 4,952,849 | A | 8/1990 | Fellows et al. | 315/307 |
| 4,953,068 | A | 8/1990 | Henze | 363/17 |
| 4,992,919 | A | 2/1991 | Lee et al. | 363/17 |
| 5,012,058 | A | 4/1991 | Smith | 219/10.55 |
| 5,017,800 | A | 5/1991 | Divan | 307/66 |
| 5,027,263 | A | 6/1991 | Harada et al. | 363/16 |
| 5,027,264 | A | 6/1991 | DeDoncker et al. | 363/16 |
| 5,105,127 | A | 4/1992 | Lavaud et al. | 315/291 |
| 5,113,334 | A | 5/1992 | Tuson et al. | 363/25 |

(Continued)

OTHER PUBLICATIONS

"An Introduction to the Principles and Features of Resonant Power Conversion", Steve Freeland, from Recent Developments in Resonant Power Conversion, Intertec Communications, Inc., 1988, pp. 20-43, No Date.

(Continued)

*Primary Examiner*—Ricardo Osorio
*Assistant Examiner*—Mansour M. Said
(74) *Attorney, Agent, or Firm*—Grossman, Tucker, Perreault & Pfleger, PLLC

(57) ABSTRACT

The present invention provides an integrated LCD panel power supply formed on a single printed circuit board. The integrated power supply includes at least one DC/AC control unit, at least one DC/DC buck converter unit and at least one DC/DC boost control unit. Each unit supplies power to an associated function of said LCD. The integrated power supply may also include an oscillator circuit generating a clock signal, and the clock signal is supplied to each unit thereby synchronizing the operation of each unit. The single PCB approach of the present invention eliminates the need for additional wiring between printed circuit boards and thereby eliminates or substantially reduces noise issues associated with such wiring.

9 Claims, 2 Drawing Sheets

U.S. PATENT DOCUMENTS

| | | | | | |
|---|---|---|---|---|---|
| 5,132,888 | A | | 7/1992 | Lo et al. | 363/17 |
| 5,132,889 | A | | 7/1992 | Hitchcock et al. | 363/17 |
| 5,157,592 | A | | 10/1992 | Walters | 363/17 |
| 5,198,969 | A | | 3/1993 | Redl et al. | 363/17 |
| 5,208,740 | A | | 5/1993 | Ehsani | 363/124 |
| 5,231,563 | A | | 7/1993 | Jitaru | 363/98 |
| 5,235,501 | A | | 8/1993 | Stuart et al. | 363/17 |
| 5,268,830 | A | | 12/1993 | Loftus, Jr. | 363/17 |
| 5,285,372 | A | | 2/1994 | Huynh et al. | 363/132 |
| 5,291,382 | A | | 3/1994 | Cohen | 363/16 |
| 5,305,191 | A | | 4/1994 | Loftus, Jr. | 363/17 |
| 5,363,020 | A | | 11/1994 | Chen et al. | 315/209 |
| 5,384,516 | A | | 1/1995 | Kawabata et al. | 315/160 |
| 5,402,329 | A | | 3/1995 | Wittenbreder, Jr. | 363/16 |
| 5,412,557 | A | | 5/1995 | Lauw | 363/37 |
| 5,418,703 | A | | 5/1995 | Hitchcock et al. | 363/17 |
| 5,420,779 | A | | 5/1995 | Payne | 363/56 |
| 5,422,546 | A | | 6/1995 | Nilssen | 315/219 |
| 5,430,632 | A | | 7/1995 | Meszlenyi | 363/17 |
| 5,430,641 | A | | 7/1995 | Kates | 363/133 |
| 5,448,155 | A | | 9/1995 | Jutras | 323/285 |
| 5,448,467 | A | | 9/1995 | Ferreira | 363/17 |
| 5,481,160 | A | | 1/1996 | Nilssen | 315/209 |
| 5,510,974 | A | | 4/1996 | Gu et al. | 363/134 |
| 5,514,921 | A | | 5/1996 | Steigerwald | 307/125 |
| 5,532,718 | A | * | 7/1996 | Ishimaru | 345/211 |
| 5,546,300 | A | | 8/1996 | Lee et al. | 363/132 |
| 5,559,688 | A | | 9/1996 | Pringle | 363/89 |
| 5,615,093 | A | | 3/1997 | Nalbant | 363/25 |
| 5,619,402 | A | | 4/1997 | Liu | 363/20 |
| 5,638,260 | A | | 6/1997 | Bees | 363/17 |
| 5,646,836 | A | | 7/1997 | Sadarnac et al. | 363/98 |
| 5,669,238 | A | | 9/1997 | Devers | 62/657 |
| 5,684,683 | A | | 11/1997 | Divan et al. | 33/65 |
| 5,694,007 | A | | 12/1997 | Chen | 315/247 |
| 5,712,533 | A | | 1/1998 | Corti | 315/169 |
| 5,715,155 | A | | 2/1998 | Shahani et al. | 363/132 |
| 5,719,474 | A | | 2/1998 | Vitello | 315/307 |
| 5,719,759 | A | | 2/1998 | Wagner et al. | 363/132 |
| 5,731,652 | A | | 3/1998 | Shimada | 310/316 |
| 5,736,842 | A | | 4/1998 | Jovanovic | 323/222 |
| 5,742,495 | A | | 4/1998 | Barone | 363/65 |
| 5,742,496 | A | | 4/1998 | Tsutsumi | 363/95 |
| 5,744,915 | A | | 4/1998 | Nilssen | 315/209 |
| 5,748,457 | A | | 5/1998 | Poon et al. | 363/16 |
| 5,764,494 | A | | 6/1998 | Schutten et al. | 363/17 |
| 5,774,346 | A | | 6/1998 | Poon et al. | 363/17 |
| 5,781,418 | A | | 7/1998 | Chang et al. | 363/16 |
| 5,781,419 | A | | 7/1998 | Kutkut et al. | 363/17 |
| 5,784,266 | A | | 7/1998 | Chen | 363/16 |
| 5,796,598 | A | | 8/1998 | Nowak et al. | 363/37 |
| 5,818,172 | A | | 10/1998 | Lee | 315/86 |
| 5,834,889 | A | | 11/1998 | Ge | 313/493 |
| 5,844,540 | A | | 12/1998 | Terasaki | 345/102 |
| 5,854,617 | A | * | 12/1998 | Lee et al. | 345/102 |
| 5,856,916 | A | | 1/1999 | Bonnet | 363/20 |
| 5,875,103 | A | | 2/1999 | Bhagwat et al. | 363/17 |
| 5,880,940 | A | | 3/1999 | Poon | 363/20 |
| 5,886,477 | A | | 3/1999 | Honbo et al. | 315/209 |
| 5,886,884 | A | | 3/1999 | Baek et al. | 363/48 |
| 5,894,412 | A | | 4/1999 | Faulk | 363/56 |
| 5,910,709 | A | | 6/1999 | Stevanovic et al. | 315/225 |
| 5,917,722 | A | | 6/1999 | Singh | 363/132 |
| 5,923,129 | A | | 7/1999 | Henry | 315/307 |
| 5,930,121 | A | | 7/1999 | Henry | 363/16 |
| 5,932,976 | A | | 8/1999 | Maheshwari et al. | 315/291 |
| 5,939,830 | A | | 8/1999 | Praiswater | |
| 5,946,200 | A | | 8/1999 | Kim et al. | 363/17 |
| 6,011,360 | A | | 1/2000 | Gradzki et al. | 315/244 |
| 6,051,940 | A | | 4/2000 | Arun | 315/307 |
| 6,114,814 | A | | 9/2000 | Shannon et al. | 315/219 |
| 6,151,232 | A | | 11/2000 | Furuhashi et al. | 363/97 |
| 6,259,615 | B1 | | 7/2001 | Lin | 363/98 |
| 6,396,722 | B1 | | 5/2002 | Lin | 363/98 |
| 6,501,234 | B1 | | 12/2002 | Lin et al. | 315/307 |
| 6,545,862 | B1 | * | 4/2003 | Gettemy et al. | 361/683 |
| 6,559,606 | B1 | | 5/2003 | Chou et al. | 315/94 |

OTHER PUBLICATIONS

Zero-Voltage Switching Techniques in DC/DC Converters, Kwang-Hwa Liu and Fred C. Lee, from Recent Develpments in Resonant Power Conversion, Intertec Communications, Inc., 1988, pp. 211-223, No Date.

"A New and Improved Control Technique Greatly Simplifies the Design of ZVS Resonant Inverters and DC/DC Power Supplies", Mehmet K. Nalbant, 1995 IEEE pp. 694-701, No date.

Switching Power Supply Design, Abraham I. Pressman, McGraw-Hill, 1991, pp. 93-104; 471-492, No date.

"Phase Shifted, Zero Voltage Transition Design Considerations and the UC3875 PWM Controller", by Bill Adreycak, Unitrode, Application Note, May 1997, pp. 1-14.

"Fixed-Frequency, Resonant-Switched Pulse Width Modulation with Phase-Shifted Control", by Bob Mammano and Jeff Putsch, from Power Supply Design Seminar, Unitrode, 1991, pp. 5-1 to 5-7.

"Zero Voltage Switching Resonant Power Conversion", by Bill Andreycak, from Power Supply Design Seminar, Unitrode, 1991, pp. A2-1 to A2-24; and A2-1A to A2-3A, No Date.

"Resonant Mode Converter Topologies", by Bob Mammano, from Power Supply Design Seminar, Unitrode, 1991, pp. P3-1 to P3-12, No Date.

The New UC3879 Phase-Shifted PWM Controller Simplifies the Design of Zero Voltage Transition Full-Bridge Converters by Laszlo Balogh, Unitrode, Application Note, 1995, pp. 1-8, No Date.

"A Comparative Study of a Class of a Full-Bridge Zero-Voltage-Switched PWM Converters", by W. Chen et al., 1995 IEEE, pp. 893-899, No Date.

Optimum ZVS Full-Bridge DC/DC Converter with PWM Phase-Shift Control: Analysis, Design Considerations, and Experimental Results, by Richard Red I et al., 1994 IEEE, pp. 159-165, No Date.

A Frequency/PWM Controlled Converter with Two Independently Regulated Outputs, by R.A. Fisher et al., HFPC, May 1989, pp. 459-471.

High Density Power-Hybrid Design of a Half-Bridge Multi-Resonant Converter, by Richard Farrington, et al., HFPC-Virginia Polytechnic Institute, May 1990, pp. 26-33.

Small-Signal Analysis of the Zero-Voltage Switched Full-Bridge PWM Converter, V. Vlatkovic et al., HFPC-Virginia Polytechnic Institute, May 1990, pp. 262-272.

Feasible Characteristics Evaluation of Resonant Tank PWM Inverter-Linked DC-DC High-Power Converters for Medical-Use High-Voltage Application, by H. Takano et al., 1995 IEEE, pp. 913-919, No Date.

Advanced Power Technology, "A New Generation of Power MOSFET Offers Improved Performance at Reduced Cost", by Ken Dierberger, 2001.

* cited by examiner

10

CCFL
20
PCB1
18
DC-AC converter
12
14
Micro Controller
24
Control Signal
Control Signal
5.0VDC
3.3VDC
DC-DC Switching converter & linear converter
22
PCB2
VDC
16
TFT LCD Source driver
30
TFT LCD Gate driver
32
Graphic data processor
26
10VDC
20VDC
-7VDC
DC-DC Switching converter & Charge pump converter
28
PCB3
(Inside LCD panle)
TFT LCD Panel
34

INTEGRATED POWER SUPPLY FOR AN LCD PANEL

FIELD OF THE INVENTION

The present invention relates to a power supply for an LCD panel display, and more particularly, to an integrated LCD panel power supply that utilizes a single printed circuit board (PCB) for all of the power function of the LCD panel, and a single clock generator for synchronizing all the power functions of an LCD panel.

BACKGROUND OF THE INVENTION

FIG. 1 depicts a conventional power supply system 10 for an LCD panel 34. In the conventional system 10, at least three separate PCBs are used to provide different power supply functions. PCB1 (12) is provided to include a DC/AC converter 18 that generates an AC signal to supply power to one or more cold-cathode fluorescent lamps (CCFLs) 20. PCB2 (14) include a DC/DC switching converter and linear converter 22 to generate DC power supply voltages for various parts of the system 10, including a microcontroller 24. The microcontroller is used, for example, as the master controller for the LCD panel functions. A third PCB, PCB (16) is provided for the graphics processing of the LCD panel. PCB3 typically includes a graphic data processor 26 a DC/DC switching converter and charge pump converter 28 to generate DC power supply voltages for a TFT LCD source driver circuit 30 and a TFT LCD gate driver circuit 32. In this conventional system, wiring is required between each of the three PCBs. Such wiring is susceptible to noise and interference from the LCD panel or other sources, which can affect the performance of the LCD panel. Also, three separate PCBs increases the overall cost of the panel and increases the number of components required to generate the required power for the LCD panel functions.

SUMMARY OF THE INVENTION

In one aspect, the present invention provides an LCD panel power supply, comprising a single printed circuit board comprising at least one DC/AC control unit, at least one DC/DC buck converter unit and at least one DC/DC boost control unit. Each unit supplies power to an associated function of the LCD panel.

In another aspect, the present invention provides an LCD panel power supply, comprising a single printed circuit board comprising at least one DC/AC control unit, at least one DC/DC buck converter unit and at least one DC/DC boost control unit. Each unit supplies power to an associated function of the LCD panel. The power supply also includes an oscillator circuit generating a clock signal, the clock signal is supplied to each unit thereby synchronizing the operation of each unit.

In yet another aspect, the present invention provides an LCD panel power supply, comprising a single printed circuit board comprising at least one DC/AC control unit, at least one DC/DC buck converter unit and at least one DC/DC boost control unit and LCD gate and source drivers power supply control units. Each unit supplies power to an associated function of the LCD panel.

In still another aspect, the present invention provides an integrated circuit that includes a bias and reference signal generator, an oscillator, at least one DC/AC inverter controller, at least one DC/DC buck regulator controller, a DC/DC boost regulator controller, and a linear regulator for controlling the power for LCD panels.

It will be appreciated by those skilled in the art that although the following Detailed Description will proceed with reference being made to preferred embodiments and methods of use, the present invention is not intended to be limited to these preferred embodiments and methods of use. Rather, the present invention is of broad scope and is intended to be limited as only set forth in the accompanying claims.

Other features and advantages of the present invention will become apparent as the following Detailed Description proceeds, and upon reference to the Drawings, wherein like numerals depict like parts, and wherein:

DETAILED DESCRIPTION OF EXEMPLARY EMBODIMENTS

Figure 2:
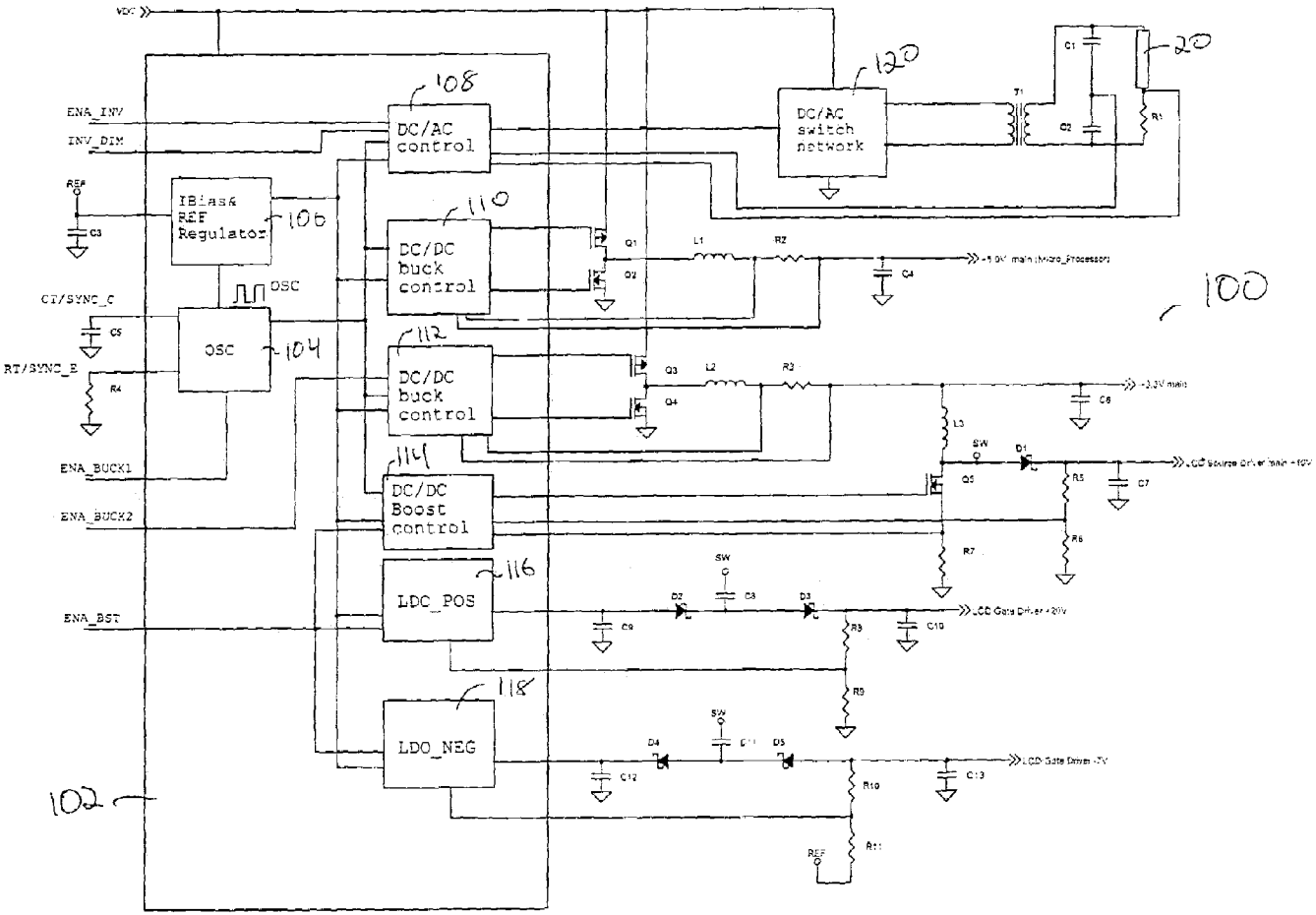
FIG. 2 is an exemplary power supply system for an LCD panel of the present invention.

FIG. 2 is an exemplary power supply system 100 for an LCD panel of the present invention. In the exemplary system, a single integrated circuit 102 is used for all the power supply functions of the LCD panel. Additionally, a single oscillator may be used to synchronize all the power supply functions of the LCD panel. Those skilled in the art will recognize that the implementation of FIG. 2 significantly saves in cost, materials and surface area as opposed to conventional LCD power supply approaches. Additionally, the integrated circuit (IC) 102 of FIG. 2 may by mounted on a single PCB, and thus, the implementation of FIG. 2 is less prone to cross noise due to cabling between PCBs as in the conventional approach.

In the exemplary system 100, IC 102 is used to host the power requirements of the LCD panel. A DC/AC inverter controller 108 is provided as a conventional and/or proprietary inverter system to generate control signals to a switch network 120 to supply power to one or more CCFL lamps 20. The inverter controller can include an inverter controller such as the OZ960, OZ961, OZ970, OZ969A, OZ971, OZ9RR, manufactured by O2Micro International Limited, and/or other inverter controller topologies known in the art, which may comprise full bridge, half bridge, push-pull and/or other switch network topologies known in the art. A first DC/DC buck controller 110 is provided to control a buck switch network (switches Q1 and Q2) in a manner well known in the art to generate a power supply (e.g. 5V) that may be used, for example, by a microprocessor associated with the power supply depicted in FIG. 2. A second buck controller 112 is provided to control a buck switch network (switches Q3 and Q4) to generate a power supply (e.g., 3.3V) for an LCD column and row drivers (not shown). Buck controllers 110 and 112 are well known topologies and may comprise custom and/or off-the-shelf components. A boost controller 114 is provided to control a boost circuit that includes a switch Q5 to generate a step-up supply voltage (e.g., 10V). LCD power switch drivers LDO_POS 116 and LDO_NEG 118 are provided to supply power to an LCD gate and source drivers with, for example, +20V and −7V, respectively.

Advantageously, in the present invention, the power supply units that require a clock, e.g., power supply units

Figure 1:
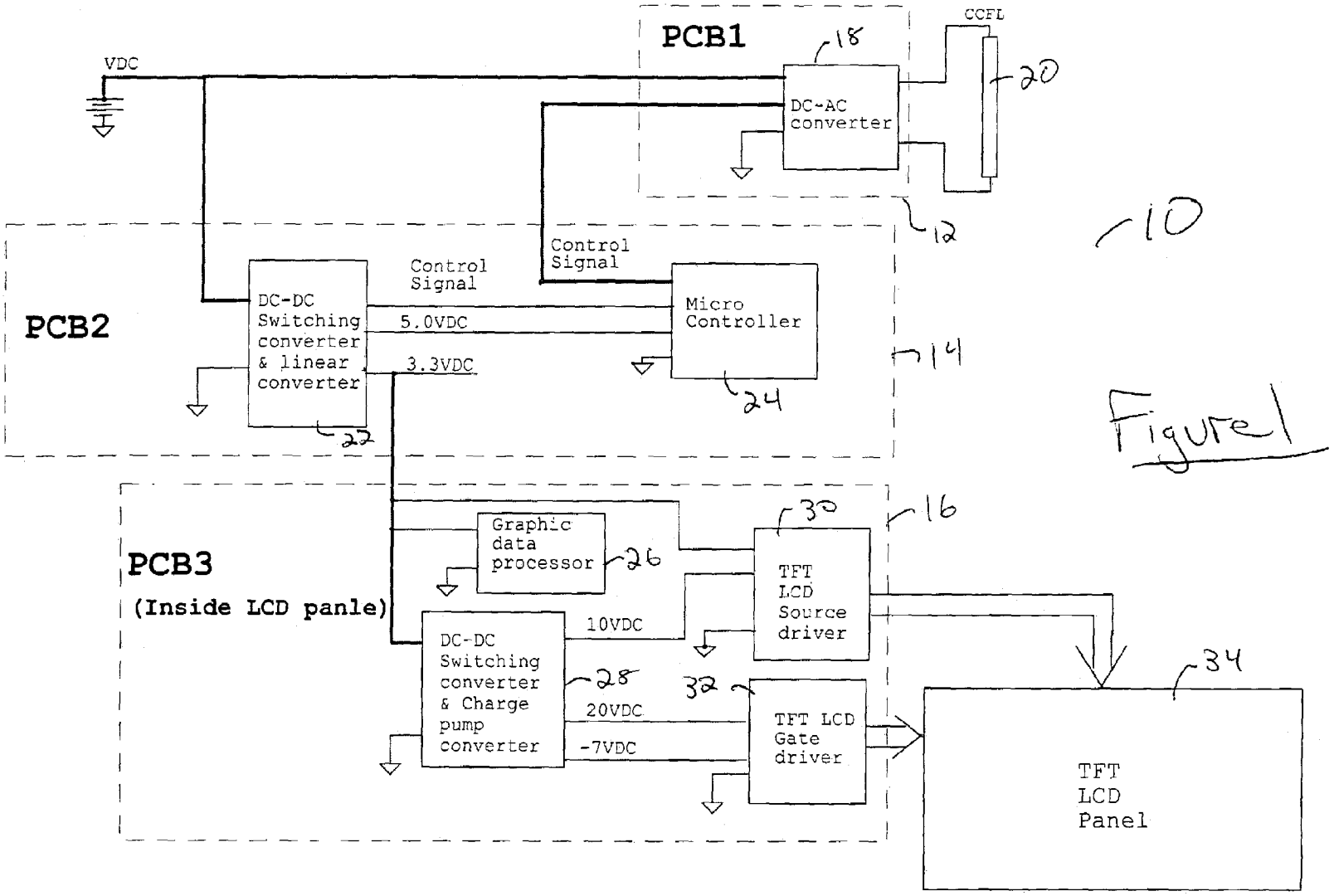
FIG. 1 is a conventional power supply system for an LCD panel.

108–114, can be synchronized. An oscillator circuit 104 is provided as a clock for each of the controller units 108–114. The oscillator circuit generates a clock pulse to each of the power supply control units 108–114. Additionally, each of the power supply control units 108–118 can be provided with a common bias signal and reference signal, via a bias a reference signal generator circuit 106 commonly tied to the power supply units. Thus, the clock, bias and reference signals can be supplied to various power supply units of the IC 102 without requiring additional wiring between PCBs as depicted in FIG. 1.

Thus, it is evident that there has been provided an integrated power supply system for an LCD panel display. There is also provided an integrated power supply system for an LCD panel display that can be implemented on a single PCB. Those skilled in the art will recognize numerous modifications to the present invention. For example, the IC 102 of FIG. 2 may instead be implemented as a plurality of discrete components as shown inside the IC 102 of FIG. 2, and all the selected components can be implemented on a single PCB, Other modifications will become apparent to those skilled in the art, all of which are deemed within the spirit and scope of the present invention, only as limited by the appended claims.

The invention claimed is:

1. An LCD panel power supply, comprising a single printed circuit board comprising:

at least one DC/AC converter unit;

at least one DC/DC buck converter unit;

at least one DC/DC boost converter unit, wherein each said at least one DC/AC converter unit, said at least one DC/DC buck converter unit and said at least one DC/DC boost converter unit supplying power to an associated function of said LCD; and an oscillator circuit generating a clock signal, said clock signal being supplied to each said at least one DC/AC converter unit, said at least one DC/DC buck converter unit and said at least one DC/DC boost converter unit thereby synchronizing the operation of each said at least one DC/AC converter unit, said at least one DC/DC buck converter unit and said at least one DC/DC boost converter unit.

2. An LCD panel power supply as claimed in claim 1, further comprising LCD gate driver and source driver power supply control units.

3. An LCD panel power supply as claimed in claim 2, further comprising a bias signal and reference signal generator circuit supplying a common bias signal and reference signal to each said at least one DC/AC converter unit, said at least one DC/DC buck converter unit and said at least one DC/DC boost converter unit.

4. An LCD panel power supply, comprising a single printed circuit board comprising at least one DC/AC converter unit, at least one DC/DC buck converter unit and at least one DC/DC boost converter unit, wherein each said at least one DC/AC converter unit, said at least one DC/DC buck converter unit and said at least one DC/DC boost converter unit supplying power to an associated function of said LCD; said printed circuit board further comprising an oscillator circuit generating a clock signal, said clock signal being supplied to each said at least one DC/AC converter unit, said at least one DC/DC buck converter unit and said at least one DC/DC boost converter unit thereby synchronizing the operation of each said at least one DC/AC converter unit, said at least one DC/DC buck converter unit and said at least one DC/DC boost converter unit.

5. An LCD panel power supply as claimed in claim 4, further comprising LCD gate driver and source driver power supply control units.

6. An LCD panel power supply as claimed in claim 5, further comprising a bias signal and reference signal generator circuit supplying a common bias signal and reference signal to each said at least one DC/AC converter unit, said at least one DC/DC buck converter unit and said at least one DC/DC boost converter unit.

7. An LCD panel power supply, comprising a single printed circuit board comprising:

at least one DC/AC converter unit;

at least one DC/DC buck converter unit;

at least one DC/DC boost converter unit;

a LCD gate driver;

a source driver power supply control units;

wherein each said at least one DC/AC converter unit, said at least one DC/DC buck converter unit and said at least one DC/DC boost converter unit supplying power to an associated function of said LCD panel; and an oscillator circuit generating a clock signal, said clock signal being supplied to each said at least one DC/AC converter unit, said at least one DC/DC buck converter unit and said at least one DC/DC boost converter unit thereby svnchronizing the operation of each said at least one DC/AC converter unit, said at least one DC/DC buck converter unit and said at least one DC/DC boost converter unit.

8. An LCD panel power supply as claimed in claim 7, further comprising a bias signal and reference signal generator circuit supplying a common bias signal and reference signal to each said at least one DC/AC converter unit, said at least one DC/DC buck converter unit and said at least one DC/DC boost converter unit.

9. An integrated circuit for controlling power to an LCD panel, comprising a single printed circuit board comprising a bias and reference signal generator, a DC/AC inverter controller, a DC/DC buck regulator controller, a DC/DC boost regulator controller, a linear regulator, and an oscillator circuit generating a clock signal, said clock signal being supplied to each said DC/AC inverter controller, said DC/DC buck regulator controller and said DC/DC boost regulator controller thereby synchronizing the operation of each said DC/AC inverter controller, said DC/DC buck regulator controller and DC/DC boost regulator controller.

* * * * *